US006202236B1

(12) United States Patent
Price

(10) Patent No.: US 6,202,236 B1
(45) Date of Patent: Mar. 20, 2001

(54) SHOOTING HARNESS

(76) Inventor: Thomas M. Price, 4216 Prairie Lane Ct., Spokane, WA (US) 99223

( * ) Notice: Subject to any disclaimer, the term of this patent is extended or adjusted under 35 U.S.C. 154(b) by 0 days.

(21) Appl. No.: 09/474,852

(22) Filed: Dec. 30, 1999

(51) Int. Cl.[7] ..... A47C 20/00; A61D 1/00

(52) U.S. Cl. ..... 5/657; 5/633; 297/464; 602/19

(58) Field of Search ..... 5/657, 652, 656, 5/633, 648; 297/464, 465; 2/44; 602/19; 450/155

(56) References Cited

U.S. PATENT DOCUMENTS

| | | | |
|---|---|---|---|
| 4,515,301 | 5/1985 | A'Costa | 224/637 |
| 4,773,106 | 9/1988 | Toso et al. . | |
| 4,813,080 | 3/1989 | Toso | 2/94 |
| 4,934,005 | 6/1990 | Martin et al. . | |
| 5,001,791 | 3/1991 | Toso | 5/630 |
| 5,083,554 | 1/1992 | Toso | 297/464 |
| 5,235,714 | 8/1993 | Toso | 5/657 |
| 5,375,279 | 12/1994 | Toso | 5/657 |
| 5,643,184 | 7/1997 | Toso | 602/19 |
| 6,083,183 * | 7/2000 | Yang | 602/19 |

* cited by examiner

*Primary Examiner*—Alexander Grosz
(74) *Attorney, Agent, or Firm*—Wells, St. John, Roberts, Gregory & Matkins, P.S.

(57) ABSTRACT

A shooting harness is described in which a back member is supported by shoulder suspension members from the shoulders and across the upper back region of a shooter. A leg restraining member extends from the back member and includes at least one knee segment positioned to engage at least one of the shooter's legs in the vicinity of the knee with the shooter in a sitting shooting position. The back member and leg restraining member together form a shooter encircling loop that provides a substantially stable brace about the shooter's upper back, torso, and at least one knee to stabilize the shooter in a sitting shooting position.

12 Claims, 7 Drawing Sheets

S
14
48
46
48
26
47
47
10
54
54
R
37
32
32
39
17
18
18
22
24
16
30
12
45
T
62
60

SHOOTING HARNESS

TECHNICAL FIELD

The present invention relates to shooting harnesses used to provide stability and increase shooting accuracy.

BACKGROUND OF THE INVENTION

An important part of shooting accurately is the ability to hold the body steady. To do this, the shooter attempts to minimize the number of articulated joints between the weapon and ground. Each body joint allows undesirable movement possibilities, so a minimal number of movable joints involved between the weapon or other hand held equipment and ground surface can translate into maximum shooting accuracy, given all other conditions being the same.

In other words, a standing off-hand shooter has a much greater chance of missing a target than a prone shooter. The prone shooter has only the joints of the hands, wrists and elbows involved between the weapon and ground surface. With the possible exception of a few vertebrae in the neck and high back, nearly all the joints of the body may become involved when the shooter is in an off-hand standing shooting position.

Obviously, the prone position is a desirable shooting stance for many shooters. However, there are many advantages to shooting from a sitting position if body movement can be minimized. A seated shooter can usually sit in locations where a prone position is not possible. Target visibility is most often better from a sitting position. It is easier, quicker, and often quieter to move to a sitting shooting position without loosing visual contact with a target.

The disadvantage of shooting from a sitting position is that more joints are involved and the chances become increased for undesired weapon movement during the targeting process. This is especially noticeable in the back and knees. The back tends to bend in an inconsistent manner, and the knees, tend to move together or apart at the hip joints. Even with these limitations, however, many shooters prefer the sitting position to off-hand standing shooting positions.

In the past, it has been known to incorporate a strap in a shooting jacket in such a manner that the strap can be extended in a hoop about the shooter's knees when in the sitting position. While this improves stability to a degree, the knees must be carefully positioned to hold the shape of the hoop. When the knees are relaxed, the hoop configuration will elongate undesirably. Exertion is required to hold the strap in a desirable hoop configuration. The shooter's legs thus may become tired and instability can result.

U.S. Pat. No. 4,515,301 to A'Costa discloses a handgun accuracy control harness with a back strap, shoulder straps, and an elongated strap part with a pistol receiving loop at an outward end. The back strap fits across the shooter's back and the shoulder straps are received over the shooter's shoulders in a manner such that the elongated strap part extends forwardly of the shooter's chest. The forward ends of the shoulder straps are mounted to the elongated strap and the elongated strap is slidably mounted to the back strap, both allowing relative freedom of movement laterally to the shooter who holds a pistol at arm's length with the grip part fitted through the loop at the outward strap end. The various straps simply provide resistance to outward extension of the shooter's arms, rather than stabilizing the shooter in a shooting position.

U.S. Pat. Nos. 4,773,106 and 5,001,791 to Toso et al disclose a back support that is used to support the lower back of a user when in a seated position. In both patents, knee loops extend from a lower back pad that is specifically provided to span the lumbar vertebrae along the lower back. The loops receive the wearer's knees and, in the '791 patent, a clip is situated along inside parts of the knee loops that is provided to connect the knee loops at an area between the hips and knees to provide resistance to separation of the knees. No shoulder straps are provided in either disclosure, since the pad is to be placed at the lower back. In the '106 patent, an additional strap is provided to extend around the user's stomach area to maintain the back support with the pad against the lumbar region while the user is standing. When the clips are joined (connecting the inward parts of the knee loops), separation of the knees is allowed, but is resisted by tension on the inward parts of the loops. These arrangements, while likely providing comfort to a person in a seated position, are not intended to and will not provide adequate stability to secure the user in a seated shooting position. This is due to the low position of the back pad and the incapability of the knee loop clip to hold the knees firmly against separation. The knees can separate, albeit with resistance offered by the knee loops, and the low position of the back pad allows considerable freedom of movement for the torso above the lumbar region.

A portable seating device is disclosed in the Martin et al U.S. Pat. No. 4,934,005. This device is comprised of a pad and strap. The pad is provided to extend across the user's back, and the strap extends outwardly to confine the user's shins when seated with the knees elevated. This arrangement, is somewhat like the Toso supports and the known strap arrangement attached to a shooting jacket. It will allow significant knee movement unless the user forces the knees apart against resistance of the strap or unless the loop is closed sufficiently to hold the knees closely together. In the situation where the user must force the knees apart, leg fatigue can seriously impair stability. In the situation where the strap is adjusted to hold the knees together, is stability is sacrificed. Thus, while this device may indeed function well to provide user comfort in a seated position, the stability required for accurate shooting is not available.

The present invention was developed in answer to the need which has remained, to improve stability for shooters in the sitting position.

An objective of the present invention is therefor to provide a shooting harness that will improve stabilization of a shooter in the sitting shooting position, especially the upper torso and knee.

A further objective is to provide a shooting harness that can be adjusted to different sizes and for different shooting conditions.

A yet further objective is to provide a shooting harness that is relatively uncomplicated and easy to use.

A still further objective is to provide a shooting harness system that provides elevational support for the shooter's torso and further establishes shooter stability in the sitting position.

The foregoing and still further objectives and advantages may become apparent from the following description, which, taken with the accompanying drawings, describe a preferred mode for carrying out the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
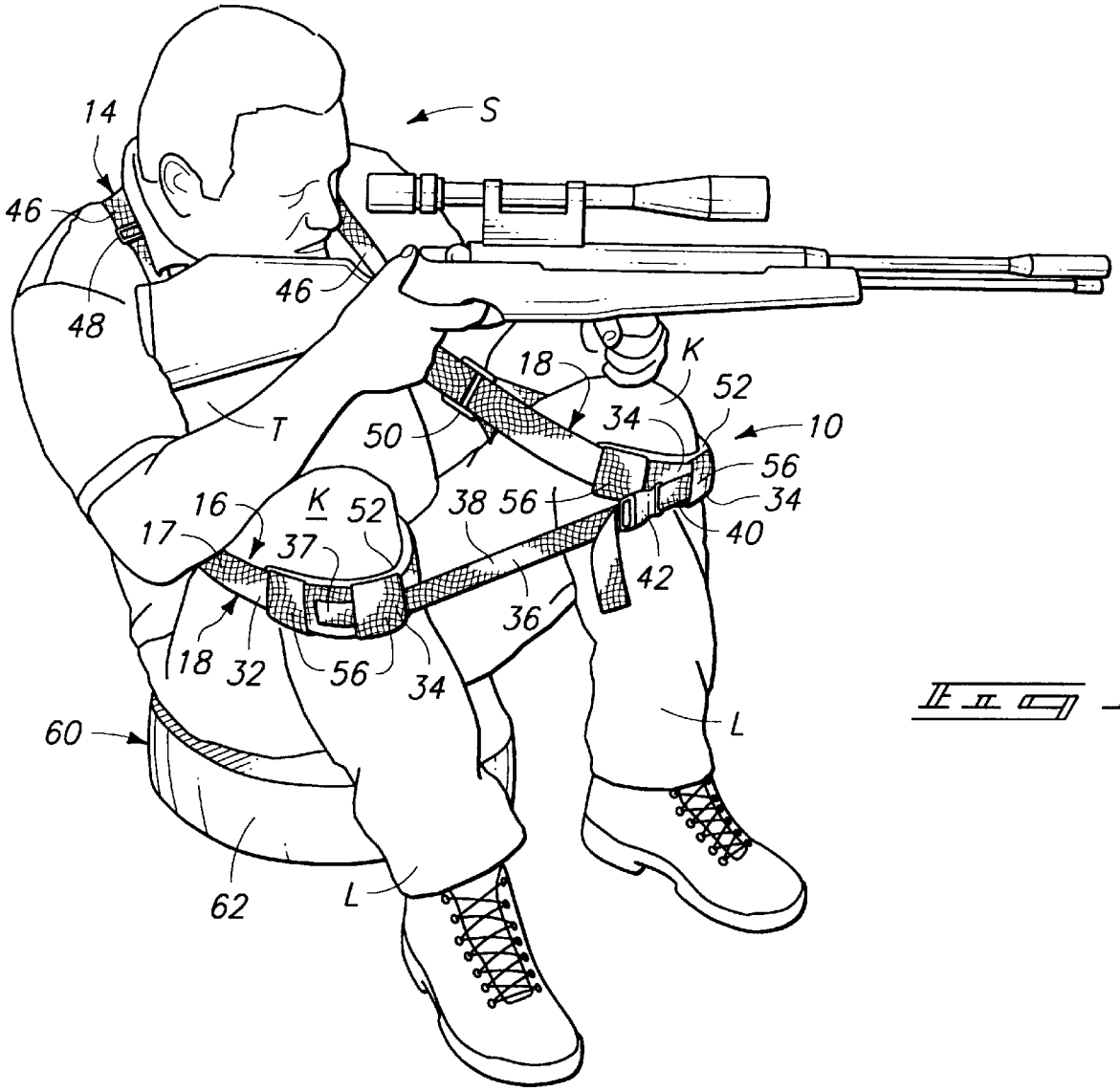
FIG. 1 is a perspective view of a shooter in a sitting position with a preferred form of the present shooting harness in place.

This disclosure of the invention is submitted in furtherance of the constitutional purposes of the U.S. Patent Laws "to promote the progress of science and useful arts" (Article 1, Section 8).

In the following description, several general individual aspects of the invention will be described, followed by more detailed description of the elements and their relationships.

Exemplary elements of the various aspects of the invention will be assigned arabic reference numerals in the following general and detailed descriptions, with the same reference numbers being used in the drawings to identify exemplary structure. Upper case letters in the description and drawings are used to identify elements that are not part of the invention but that are used to assist in describing the exemplified structure.

Figure 4:
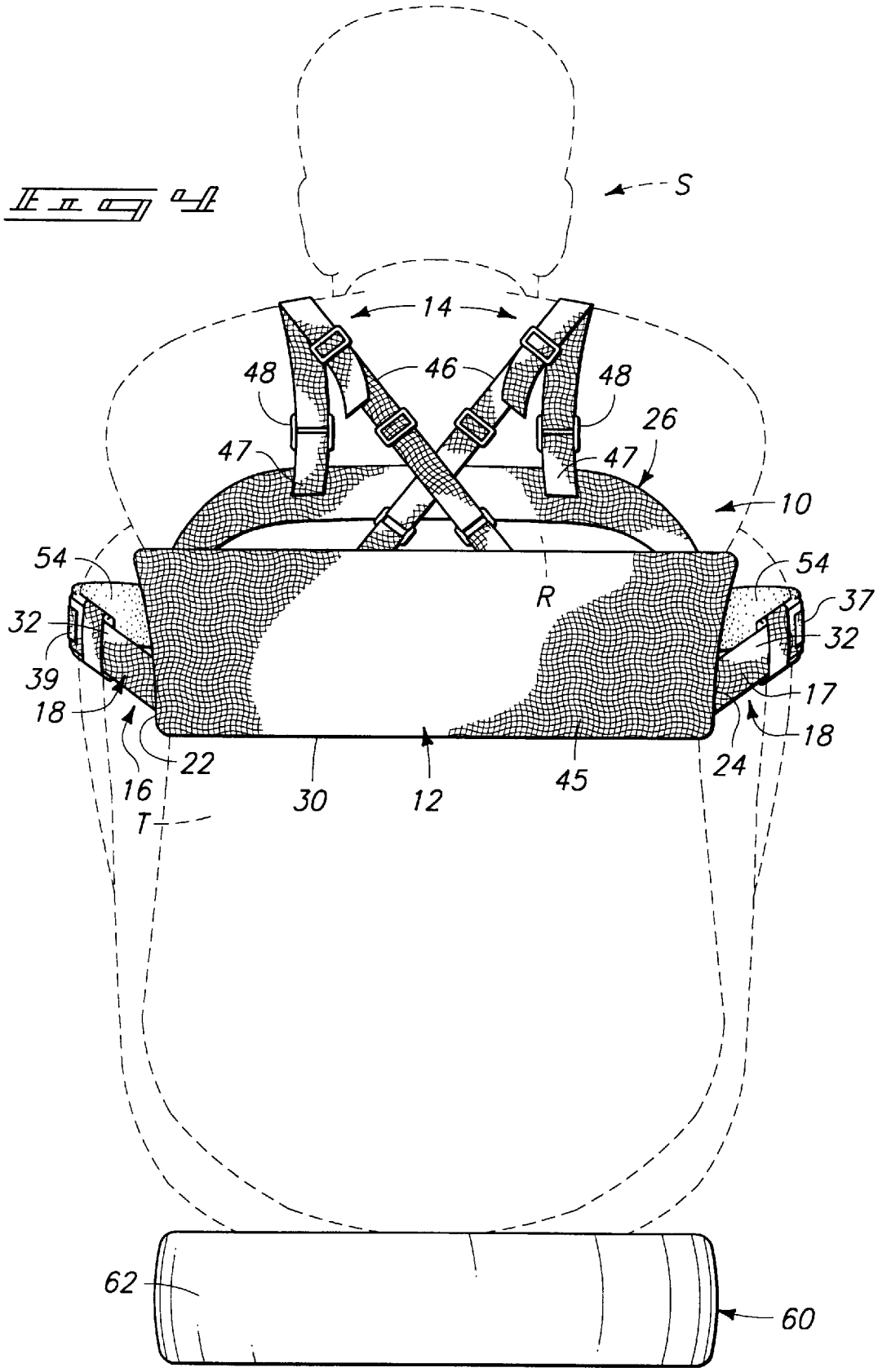
FIG. 4 is rear view, once again with the shooter identified by dashed lines.

In one general aspect, a shooting harness 10 includes a back member 12. Shoulder suspension members 14 are connected to the back member 12 to suspend the back member 12 from the shoulders of a shooter S across the upper back region R of the shooter (see generally FIGS. 2 and 4). A leg restraining member 16 extends from the back member 12. At least one knee segment 18 is provided on the leg restraining member 16, positioned to engage at least one of the shooter's legs L in the vicinity of a knee K, with the shooter in a sitting shooting position. The back member 12 and leg restraining member 16 together form a shooter encircling loop 20 (identified by the heavy line in FIG. 5) that provides a substantially stable brace about the shooter's upper back R, torso T, and at least one knee K to stabilize the shooter S in a sitting shooting position.

In another aspect, the shooting harness 10 generally includes an elongated cushioned back member 12 extending between first and second ends 22, 24. A chest strap 26 is mounted to the back member 12 and extends from the back member ends 22, 24 to encircle the torso T of a shooter S at approximately chest height. Shoulder suspension members 14 are connected to the back member 12 to suspend the back member from the shoulders of a shooter across the upper back region of the shooter S. A leg restraining strap 17 extends from the back member. A knee segment 18 on the leg restraining strap 17 is positioned to engage a shooter's bent leg L in the vicinity of a knee K with the shooter S in a sitting shooting position. The back member 12 and leg restraining strap 17 together form a shooter encircling loop 20 that provides a substantially stable brace about the shooter's upper back R, torso T, and bent leg L to stabilize the shooter in a sitting shooting position.

In another aspect the shooting harness 10 includes an elongated padded back member 12 including a top edge 28, a bottom edge 30 and opposed end edges 22, 24 joining the top and bottom edges. Shoulder suspension members 14 are connected to the back member 12 adjacent the top edge 28 to suspend the back member from the shoulders of a shooter S across the upper back region R. A leg restraining strap 17 extends across the back member and outwardly of the end edges 22, 24. Knee loop segments 32 are formed on the leg restraining strap 17. The knee loop segments 32 are shaped to engage the shooter's legs L in the vicinity of the knees K with the shooter in a sitting shooting position and with the knees elevated. The knee loop segments 32 extend to outward ends 34 that are configured to be positioned along forward surfaces of a shooter's knees K. A knee restraint strap 36 includes two sections 38, 40, each section being affixed to a respective knee loop segment 32 adjacent the associated outward end 34. A buckle 42 releasably connects the two sections of the knee restraint strap 36. The back member 12, leg restraining strap 17 and knee restraint strap 36 form a shooter encircling loop 20 that provides a substantially stable brace about the shooter's upper back R, torso T, and upwardly bent knees K to stabilize the shooter S in a sitting shooting position.

In another aspect, the shooting harness is provided in a system, which includes a back member 12 and shoulder suspension members 14 connected to the back member 12 to suspend the back member 12 from the shoulders of a shooter S across the upper back region R of the shooter S. A leg restraining member 16 extends from the back member 12, with at least one knee segment 18 on the leg restraining member 16 positioned to engage at least one of the shooter's legs L in the vicinity of the knee K with the shooter in a sitting shooting position. A shooter elevating support 60 is positionable below the back member 12 and is configured to be placed under the shooter's buttocks to elevate the shooter's torso T above a support surface. The back member 12 and leg restraining member 16 together form a shooter encircling loop that provides a substantially stable brace about the shooter's upper back R, torso T, and at least one knee K, with the elevating support 60 positionable beneath the back member 12 and shooter's buttocks to support the shooter's torso T and to stabilize the shooter in a sitting shooting position.

Figure 2:
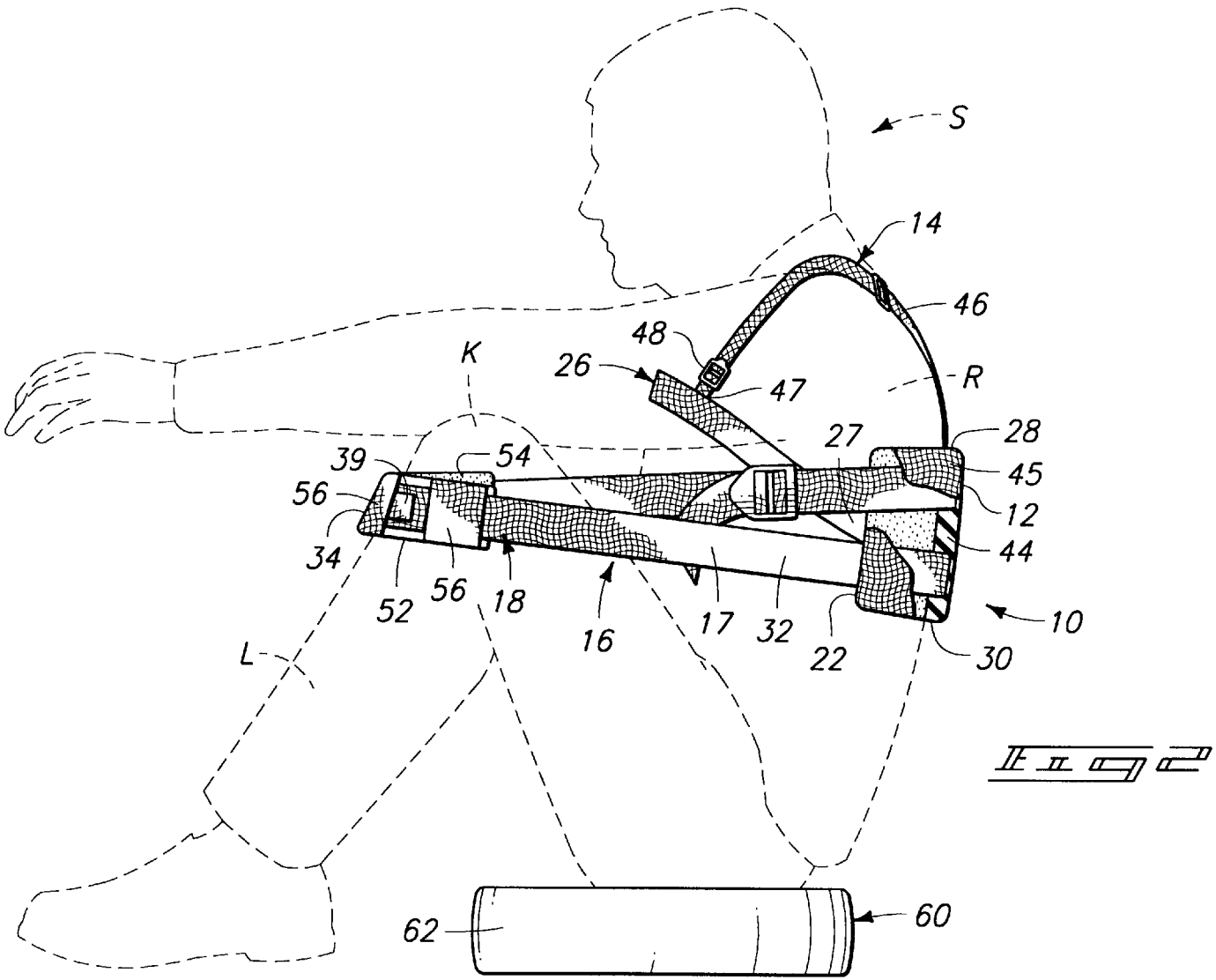
FIG. 2 is a partially fragmented side elevation view of the harness with the shooter shown in dashed lines and with the arms held upward to better show the harness.
Figure 6:
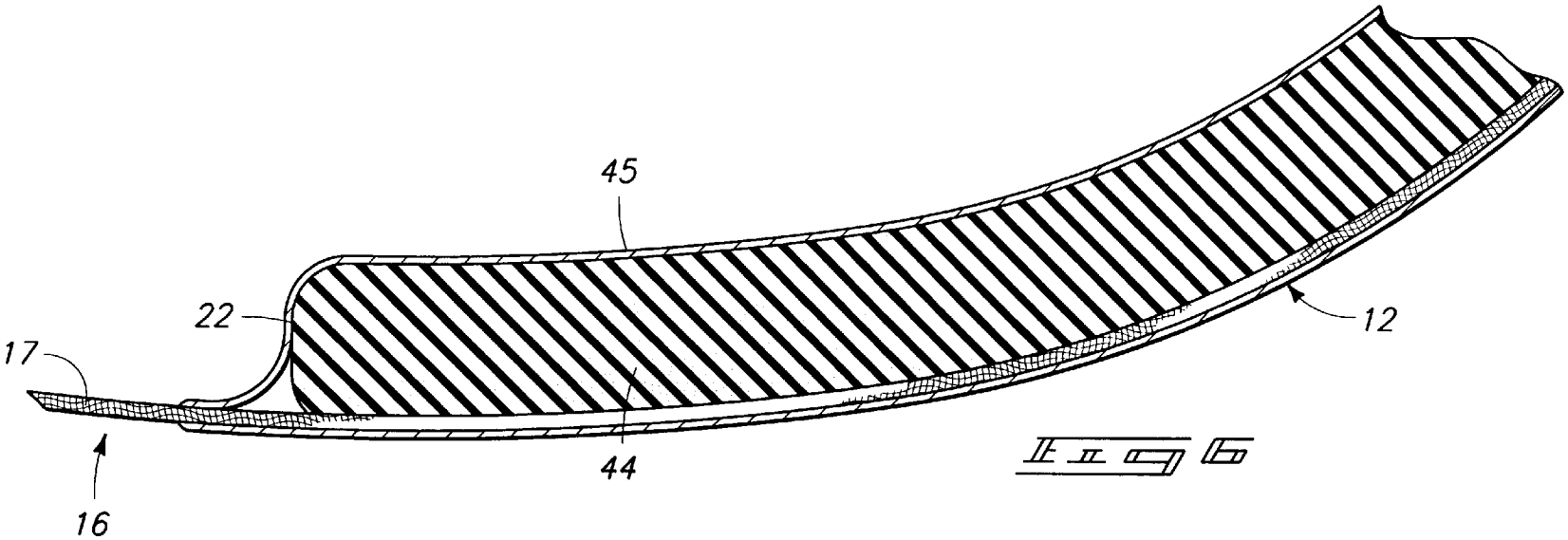
FIG. 6 is an enlarged detail view of the area identified at 6 in FIG. 5, showing a segment of the back member and internal pad.

Referring now in greater detail to FIGS. 2 and 6, the back member 12 is shown including a resilient pad core 44 encased in a synthetic or natural fiber envelope 45. The end edges 22, 24, top edge 28, and bottom edge 30 are joined or folded to form the envelope 45. Edges that are joined may be sewn, glued, or otherwise secured in a conventional manner.

The length of the back member 12 may be produced according to the size of the shooter, but in general is preferably approximately equal to the width dimension across the upper back R adjacent the shoulder blades. When in place on the shooter, the member 12 may be formed about the upper back with the end edges 22, 24 terminating in rearward proximity to the shooter's underarms.

The shoulder suspension members 14 are preferably comprised of a pair of adjustable shoulder straps 46 connected to the back member 12. Preferably the shoulder straps 46 connect to the back member adjacent the top edge 28, to suspend the back member 12 across the upper back R of the shooter.

The exemplified shoulder straps 46 may be formed of woven, braided or solid conventional synthetic or natural longitudinally stable (substantially inelastic) strapping materials, and may be adjustable by means of buckles 48. Forward ends 47 (FIGS. 4, 5) of the shoulder straps 46 may be affixed to the chest strap 26, in forms where the chest strap is provided. Otherwise the same strap ends 47 could, for example, extend in loop configurations (see FIG. 8) and be attached to the respective back member ends 22, 24.

In preferred configurations, the straps 46 are provided to hold the back member 12 at a high elevation across the shooter's back, in order to best stabilize the shooter in the sitting position. This orientation minimizes the number of vertebrae involved in the shooting position since the shooter need only press rearwardly against the back member and the lower back will become fairly rigid between the ground and back member 12.

It is pointed out that if the shoulder straps 46 were eliminated and the back member 12 was allowed to be positioned on or to simply slide down to the lower back, the upper vertebrae will not be confined, and the shooter's upper torso could move about freely. This is not desirable for shooting, since stability would be seriously compromised.

Figures 8, 9:
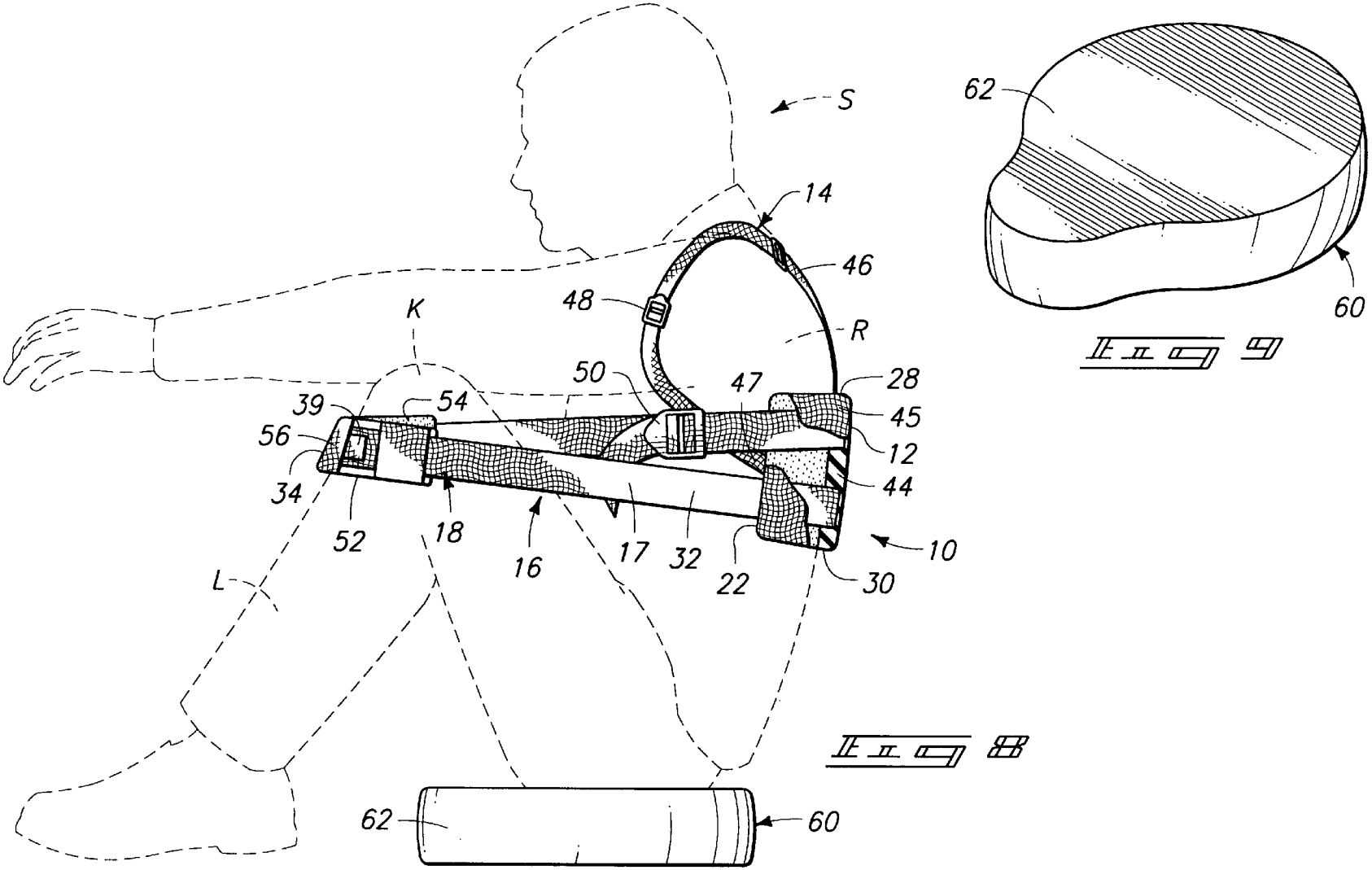
FIG. 8 is a view similar to FIG. 2 only showing an alternative configuration without a chest strap.
FIG. 9 is a perspective view of a shooter elevating support.

The chest strap 26 may be optional. FIG. 8 illustrates an embodiment in which the chest strap is eliminated (compare to FIG. 2). As noted above, elimination of the chest strap results in a different configuration for the shoulder straps, which are needed to hold the back member 12 high on the shooter's back. Without the chest strap, the shoulder straps 46 are connected at opposed ends to the back member, preferably at the top edge 28 and ends 22, 24. As shown in FIG. 8, the shoulder straps extend up from the top edge 28, over the shooter's shoulders, then under the arms to connect at the back member ends 22, 24. The shoulder straps in this version are also adjustable as described for the preferred form illustrated in FIGS. 2 and 5.

Preferred forms of the present shooting harness, however, make use of the chest strap 26 to hold the back member ends 22, 24 closely adjacent to the shooter's back adjacent the armpits. This provides a degree of comfort when the harness is to be worn while the shooter is standing or moving about.

Figure 3:
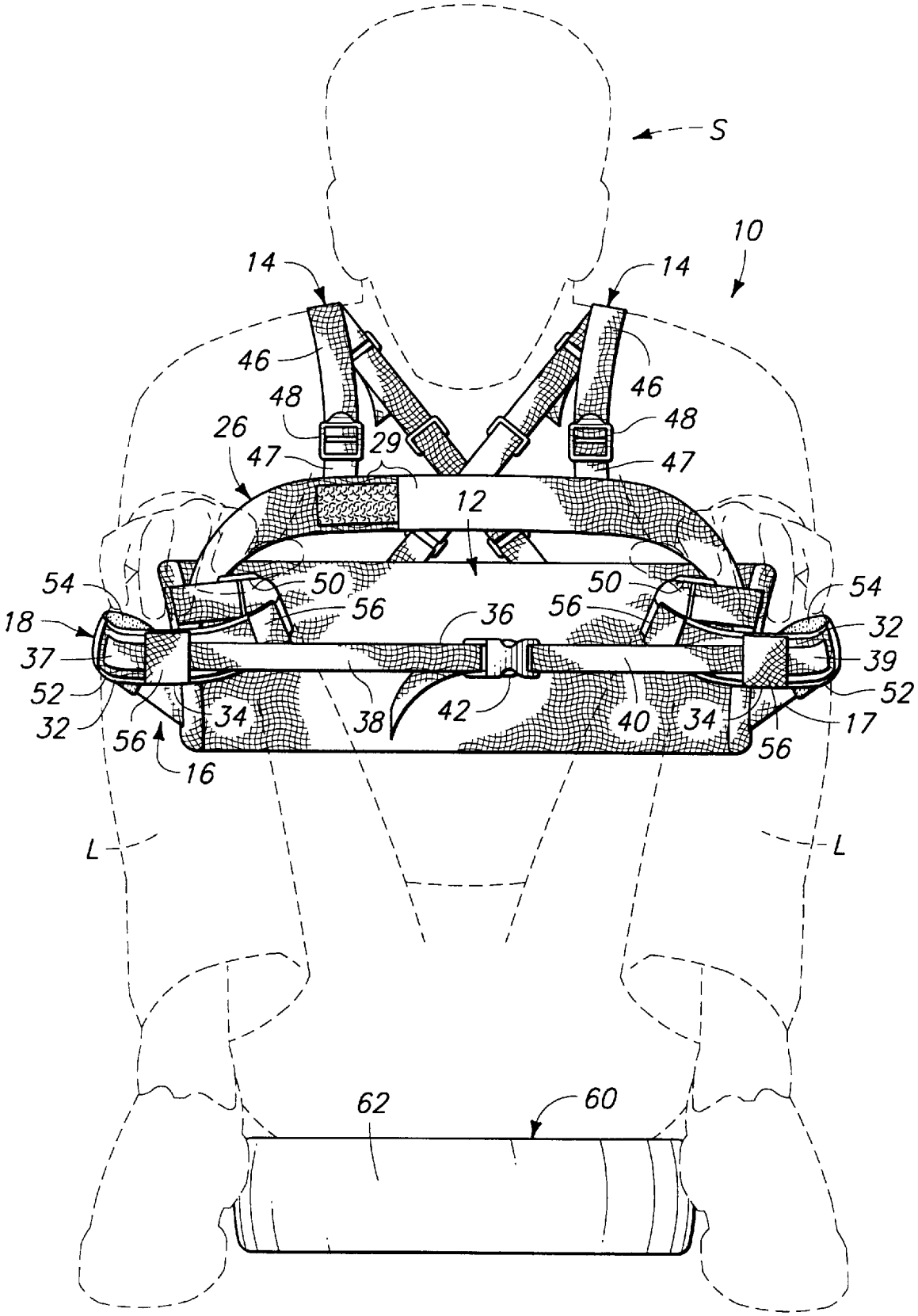
FIG. 3 is a front elevation, again with the shooter shown by dashed lines.

The preferred chest strap 26 is provided in separable sections that extend from ends 27 (FIG. 2) which are affixed to respective ends 22, 24 of the back member 12. The chest strap sections extend from the ends 27 to forward ends 29 (FIG. 3) that can be adjustably fastened together across the shooter's chest by means of hook and loop fastener material, buckles, or other conventional adjustable fasteners. The chest strap, unlike the remaining straps comprising the shooter encircling loop 20, may be partially elastic to allow for natural expansion and contraction of the shooter's chest during breathing.

The leg restraining member 16 generally described above, preferably is comprised of a leg strap 17 that extends across the back member 12 and outward to at least one knee segment 18 to engage and restrain at least one and most preferably both of the shooter's legs when in a seated shooting position. Most preferably, the leg restraining member includes two of the knee segments 18, one for each of the shooter's knees.

The leg strap 17 may be formed of similar substantially non-extensible material as the shoulder straps 46 forming the knee loop segments 32. At least one loop length adjustment buckle 50 may be provided to facilitate selective adjustment of the loop size. The buckles 50 enable adjustment to accommodate shooters of different size and physical conditions, and to enable adjustment to accommodate different shooting conditions. For example, downhill, sidehill, flat and uphill shooting conditions can be accommodated by adjusting the loop size to allow one or both of the shooter's knees to be drawn closer to the torso or positioned further away.

Figure 5:
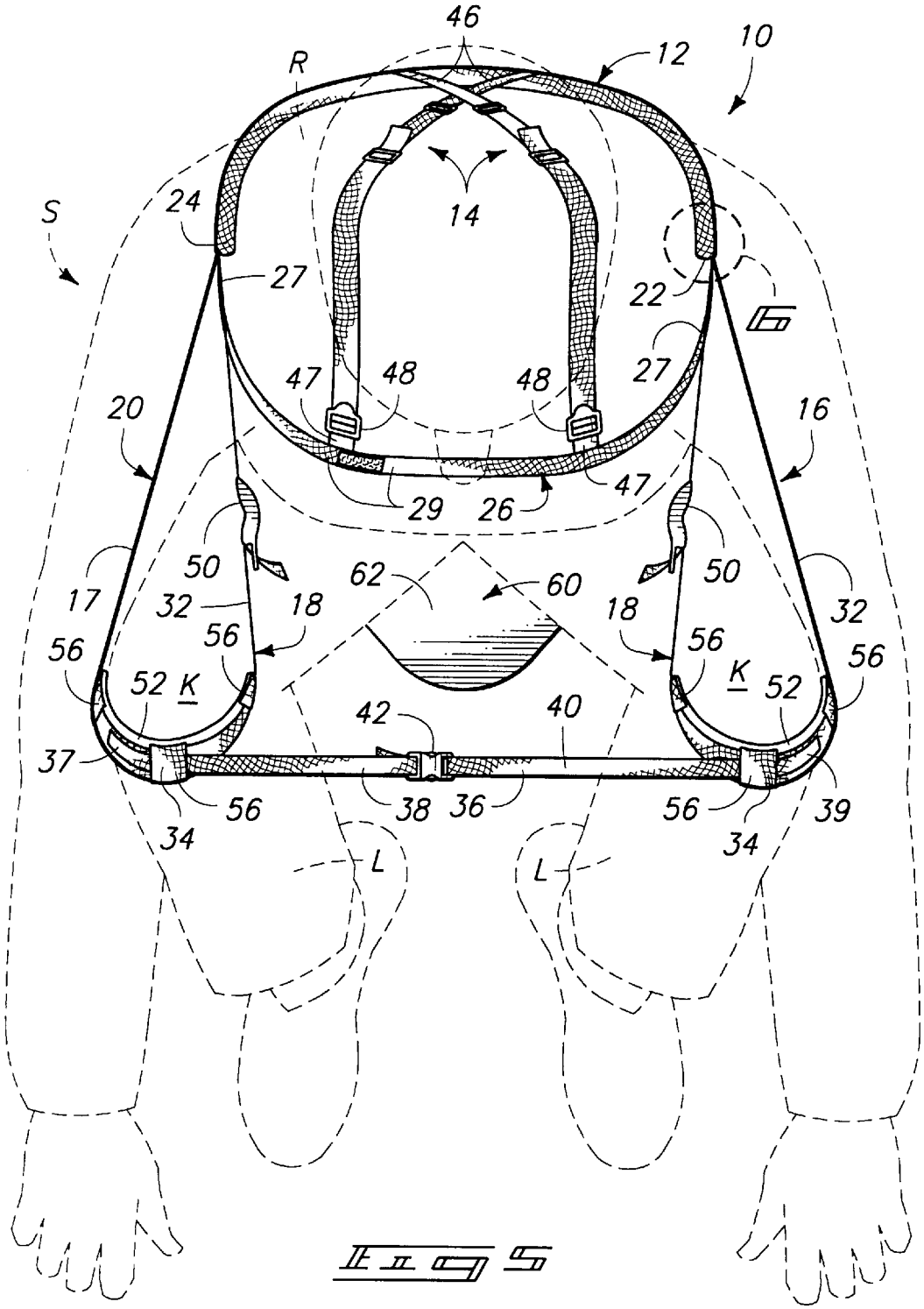
FIG. 5 is top plan view of the harness and with the shooter in dashed lines.

In preferred forms, the knee segment 18 is an assembly that includes two knee loop segments 32, each including a loop length adjustment buckle 50 (preferably located on inwardly facing parts of the loop segments 32 as shown adjacent the inner thighs of the shooter in FIG. 5) to facilitate independent loop size adjustment for each leg. The buckles 50 thus allow for either right or left leg to be independently positioned according to variations as discussed above.

As shown in FIG. 5, the knee loop segments 32 may be mounted to the shooter's legs in such a manner that inner parts of the loop segments are situated adjacent inward surfaces of the shooter's thighs, and outward parts of the loop segments are situated adjacent outward surfaces of the shooters thighs. The outward loop ends 34 are thus situated adjacent the forwardmost surfaces of the user's knees.

A knee engaging pad 52 is advantageously provided on each of the knee receiving loop segments 32 at the loop end 34 and is positioned thereon to engage a shooter's leg downwardly adjacent the knee K. Each of the pads 52 include an internal resilient pad of a synthetic rubber or similar material for distributing forces across the engaged parts of the shooter's legs.

Figure 7:
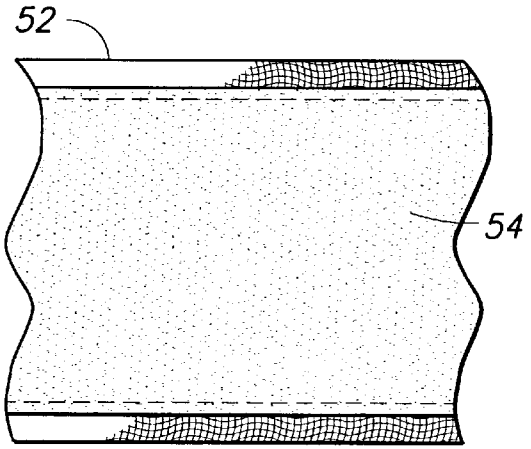
FIG. 7 is a fragmented view illustrating a high friction surface on a knee pad.

A high friction surface 54 (FIG. 7) may be provided on inside surfaces of the knee pads 52 to aid in holding the pads secure with respect to the shooter's knees. The surfaces 54 may be formed by a flexible sheet material selected from commercially available synthetic high friction materials. The sheet material is sewn, glued or otherwise secured to the pads with the surfaces 54 facing inwardly to engage the shooter's legs.

FIG. 1, shows an exemplary connection between the pads 52 and associated parts of the knee segment portions of the leg restraining strap 17. The preferred pads 52 are slidably secured to the knee loop segments 32 of the leg restraining strap by fabric loops 56 that are formed on outside surfaces of the pad envelope material. The pad loops 56 allow adjustment of the pads 52 toward the inside or outside surfaces of the shooter's knees. In the illustrated example, three separated loops 56 are provided on each pad, slidably receiving the associated knee loop segment 32.

The leg restraining member 16 is completed, forming the shooter encircling loop 20, by the knee restraining strap 36 which extends between the knee loop segments 32. It is noted that a preferred form of the knee restraint strap 36 is connected by sewing or other appropriate fastening technique, toward the outward ends 34 of the knee loop segments 32.

It is preferable, as illustrated in FIG. 5, that the restraint strap ends are secured to the knee loop segments 32 between adjacent pad loops 56. The strap 36 thus functions to limit sliding motion of the pads 52 to the vicinity of the outward knee loop ends 34. Conversely, the loops 56 confine the strap to extend substantially tangentially from the outermost parts of the shooter's knees.

It is noted that the knee restraint strap ends are affixed to the knee loop segments at or adjacent to the outward loop ends 34. This is done so the knee restraint strap 36 and leg strap 17 will form a continuous encircling loop 20 about the shooter (see FIG. 5) that is substantially unyielding.

In preferred forms, points 37, 39 where the knee restraint strap 36 is sewn or otherwise attached to the knee loop segments are located beyond the outward loop ends 34 (see FIGS. 3 and 5) and along the outward parts of the loops. This is done so that when mounted to a shooter, the knee restraint strap 36 will extend normally around the knees and attach to the knee loop segments at points toward the outside of the thighs. This, along with the loops 56 at outward loop ends 34 provides for adjustability of the knee loop lengths while assuring that the knee restraint strap 36 will extend across the front surfaces of the knees (rather than inside the thighs) and provide stable support.

If the knee restraint strap 36 was mounted to the inward parts of the knee loop segments (for example at points adjacent the length adjustment buckles 50), a very undesired degree of resiliency would be introduced. The inward loop segment parts (those parts of the knee loop segments extending along the inside or facing surfaces of the knees and thighs) would bow as the knees separate. This would allow undesirable flexibility in the shooter's sitting stance that would most likely result in shooting inaccuracy.

Instead, preferred forms of the knee restraint strap 36 extend around the knees to the outwardly facing parts of the knee loop segments as noted above, so longitudinal rigidity of the shooter encircling loop 20 is maintained even with selective adjustment of the knee loop lengths and adjustment of the knee restraint strap length. Thus, while the forwardmost mounting points 34 for the knee restraint strap 36 may be used, there is a degree of allowable variance for the knee restraint mounting points, preferably between the loop ends 34 and toward the outside parts of the knee loop segments 32.

The shooter elevating support 60 as exemplified in FIG. 9 and shown in use in FIG. 1, is comprised in preferred forms of a cushion with sufficient thickness to elevate the shooter's torso. The cushion may be comprised of a fabric envelope 62 housing a conventional padding material such as a synthetic or natural rubber.

It is preferred that the padding and envelope be of sufficient thickness to elevate the shooter's torso at least about 2.5 inches above the underlying support surface. It has been found that the support 62, configured as described may be positioned below the back member 12 and under the user's buttocks, to add even further stability for the shooter.

The support 60 serves to raise the torso in relation to the shooter's feet and the support surface below. So elevated, the torso will not have a tendency to tip backwardly and raise the feet. Rather, the feet will remain planted even when the shooter leans back against the back member 12. Further, the support 60 provides an added level of comfort not typically attainable by sitting on a hard surface.

Operation of the shooting harness 10 will now be explained.

A shooter may don the harness 10 simply by inserting his or her arms through the shoulder suspension members 14 in such a manner that the straps 46 form an X across the back between the shoulder blades. The shoulder strap buckles 48 may now be adjusted so the back member 12 is suspended by the straps 46 across the upper back, adjacent to or spanning the shoulder blades. In preferred versions where the chest strap 26 is provided, the shooter may now adjust and fasten the strap ends across the chest.

The above steps secure the harness in position on the shooter's torso in such a manner that the back member 12 is secured across the upper back R. Location of the back member 12 in this position will assure a stable shooting stance when the shooter is in the seated shooting position.

The shooter may now sit. In preferred forms, the support 60 is first placed on the ground or floor surface. The shooter then lowers him or herself onto the support 60 so the buttocks rest on the support below the back member 12. He or she may then bring the knees upward toward the chest as shown in FIG. 1.

Once the shooter is seated at a desired orientation, each of the knee loop segments 32 is fitted over a respective knee K. The pads 52 are positioned to engage the legs at or more preferably just below the knee joints (FIG. 2). The loop ends 34 are most preferably situated at the forwardmost surfaces of the engaged leg surfaces, substantially as illustrated in FIGS. 1 and 5.

As may be noted in FIG. 5, the knee loop length adjustment buckles 50 are now situated along inward parts of the knee loop segments 32. The buckles are thus easily accessible to facilitate adjustment of the respective loop size. This adjustment may be made to accommodate different size shooters, and to allow for variable placement of the knees in the shooting stance.

As an example, a shooter with long legs may wish to adjust the loops to different lengths than a shooter with short legs. In match shooting with the target on the same basic horizontal plane as the shooter, both knees may be held at basically the same elevation.

Alternatively, when shooting downhill from a horizontal surface, the shooter may wish to draw the uphill knee up higher than the downhill knee, or vice-versa for uphill shooting.

Once the harness is appropriately adjusted, the shooter may shoulder his or her weapon substantially in the manner shown in FIG. 1. When doing so, the shooter may lean the upper back rearwardly, thereby placing the entire shooter encircling loop 20 in tension between the knees and back. This stabilizes the upper back and knees in a substantially horizontal plane. Further a vertically stable three point contact is achieved between the feet, the buttocks, and the ground. The weapon may thus be held in a very stable and accurate condition, with the forestock stable across one knee and the butt snug against the shoulder and braced from the other knee.

By using the present harness 10 in the manner described, shooting accuracy may be attained with accuracy approaching or even surpassing that which is otherwise obtainable only from a prone position or by shooting from a bench rest.

It is pointed out that while the drawings illustrate the shooter S using a rifle, other weapons or hand held equipment may also be stabilized using the present harness. For example, shotgun shooters, archers, air rifle shooters, cross bow shooters, and others may make use of the stabilizing capability of the present harness. Still further, it quite feasible that photographers, especially outdoor photographers who use telephoto lenses, could also make use of the stabilizing advantages of the present invention. The invention could also be used to advantage by persons operating other accuracy sensitive hand held equipment from a seated position. The term "shooting" should thus be taken in a broad context and not be considered as limiting the utility of the present invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A shooting harness, comprising:

a back member;

shoulder suspension members connected to the back member to suspend the back member from the shoulders of a shooter across the upper back region of the shooter;

a leg restraining member extending from the back member;

the leg restraining member is comprised of a pair of knee loop segments mounted to the back member and extending from the back member to loop ends, with each knee loop segment including an inside part and an outside part to receive one of a sitting shooter's knees, with the inside parts configured to be situated adjacent inner surfaces of the shooter's thighs and the outside parts configured to be situated adjacent outer surfaces of the shooter's thighs;

a knee restraint strap extending between the pair of knee loop segments;

wherein the knee restraint strap is attached to the knee loop segments at points adjacent to the outside parts and loop ends;

whereby the back member and leg restraining member together form a shooter encircling loop that provides a substantially stable brace about the shooter's upper back, torso, and at least one knee to stabilize the shooter in a sitting shooting position.

2. A shooting harness, as defined by claim 1 wherein the back member includes an elongated pad shaped to span the upper back of a shooter adjacent the shoulder blades.

3. A shooting harness, as defined by claim 1, and further including loop length adjustment buckles on the knee loop segments.

4. A shooting harness, as defined by claim 1, further including:

loop length adjustment buckles on the loop segments; and wherein the shoulder suspension members are comprised of adjustable shoulder straps connected to the back member.

5. A shooting harness, comprising:

an elongated cushioned back member extending between first and second ends;

a chest strap mounted to the back member and extending from the back member ends to encircle the torso of a shooter at approximately chest height;

shoulder suspension members connected to the back member to suspend the back member from the shoulders of a shooter across the upper back region of the shooter;

a leg restraining strap extending from the back member; the leg restraining strap including a pair of knee loop segments extending from the back member to loop ends, each being configured to receive one of a sitting shooter's knees;

a knee engaging pad at each loop end; and a knee restraint strap extending between the pair of knee loop segments at the loop ends;

whereby the back member and leg restraining strap together form a shooter encircling loop that provides a substantially stable brace about the shooter's upper back, torso, and bent leg to stabilize the shooter in a sitting shooting position.

6. A shooting harness, as defined by claim 5 wherein the knee restraint strap includes two sections respectively affixed to the knee engaging loop segments at the loop ends; and wherein the two sections of the knee restraint strap are releasably connected by a buckle.

7. A shooting harness, as defined by claim 5 further comprising a high friction pad on at least one of the knee engaging pads.

8. A shooting harness, comprising:

an elongated padded back member including a top edge, a bottom edge and opposed end edges joining the top and bottom edges;

shoulder suspension members connected to the back member adjacent the top edge to suspend the back member from the shoulders of a shooter across the upper back region of the shooter;

a leg restraining strap extending across the back member and outwardly of the end edges thereof;

knee loop segments formed on the leg restraining strap, the knee loop segments being shaped to engage the shooter's legs in the vicinity of the knees with the shooter in a sitting shooting position and with the knees elevated;

wherein the knee loop segments extend to outward ends configured to be positioned along forward surfaces of a shooter's knees;

a knee restraint strap;

wherein the knee restraint strap includes two sections, each section being affixed to a respective knee loop segment adjacent the associated outward end;

a buckle releasably connecting the two sections of the knee restraint strap;

whereby the back member, leg restraining strap and knee restraint strap form a shooter encircling loop that provides a substantially stable brace about the shooter's upper back, torso, and upwardly bent knees to stabilize the shooter in a sitting shooting position.

9. A shooting harness, as defined by claim 8 further comprising a knee pad on each of the knee loop segments at the outward ends of the respective knee loop segments.

10. A shooting harness, as defined by claim 8 further comprising a knee pad on each of the knee loop segments, and wherein the knee pads include high friction surfaces for securing the knee loop segments against a shooter's legs in the vicinity of the knees.

11. A shooting harness system, comprising:

a back member;

shoulder suspension members connected to the back member to suspend the back member from the shoulders of a shooter across the upper back region of the shooter;

a leg restraining member extending from the back member;

at least one knee segment on the leg restraining member positioned to engage at least one of the shooter's legs in the vicinity of the knee with the shooter in a sitting shooting position;

a shooter elevating support positionable below the back member and configured to be placed under the shooter's buttocks to elevate the shooter's torso above a support surface;

whereby the back member and leg restraining member together form a shooter encircling loop that provides a substantially stable brace about the shooter's upper back, torso, and at least one knee, with the elevating support positionable beneath the back member and shooter's buttocks to support the shooters torso and to stabilize the shooter in a sitting shooting position.

12. A shooting harness system, as defined by claim 11 wherein the pad has a thickness sufficient to elevate the shooter's torso above a support surface by a distance of at least about 2.5 inches.

* * * * *